US010400441B1

(12) United States Patent
Bevis

(10) Patent No.: US 10,400,441 B1
(45) Date of Patent: Sep. 3, 2019

(54) STORAGE TANK FLOOR-WALL JOINT CONNECTION DEVICE

(71) Applicant: CROM, LLC, Gainesville, FL (US)

(72) Inventor: Gerald C. Bevis, Gainesville, FL (US)

(73) Assignee: CROM, LLC, Gainesville, FL (US)

( * ) Notice: Subject to any disclaimer, the term of this patent is extended or adjusted under 35 U.S.C. 154(b) by 0 days.

(21) Appl. No.: 15/966,750

(22) Filed: Apr. 30, 2018

Related U.S. Application Data

(60) Provisional application No. 62/492,048, filed on Apr. 28, 2017.

(51) Int. Cl.
*E04B 1/68* (2006.01)

(52) U.S. Cl.
CPC ..... *E04B 1/6806* (2013.01)

(58) Field of Classification Search
CPC ..... E04B 1/6806
USPC ..... 52/169.7, 396; 405/54
See application file for complete search history.

(56) References Cited

U.S. PATENT DOCUMENTS 2,865,267 A * 12/1958 Bailey ..... E02D 29/16 404/56
2,932,964 A * 4/1960 Dobell ..... E01C 11/106 220/614
2,937,065 A * 5/1960 Camphausen ..... E01C 11/106 24/DIG. 51
3,092,933 A * 6/1963 Closner ..... E04H 7/20 220/560.05
3,172,237 A * 3/1965 Bradley ..... E01C 11/106 404/64
3,199,541 A * 8/1965 Richitelli ..... B29C 53/785 138/129
3,280,525 A * 10/1966 Crowley ..... E04H 7/20 52/223.3
3,385,016 A * 5/1968 Crom ..... E04B 1/6806 52/249
3,884,000 A * 5/1975 Faleij ..... E04B 1/6807 249/9
3,956,557 A * 5/1976 Hurst ..... E04B 1/6806 428/167
4,056,909 A * 11/1977 Bernardo ..... E04B 1/6806 404/61
RE29,777 E * 9/1978 Crowley ..... E04H 7/20 52/169.4
4,287,691 A * 9/1981 Guenther ..... B65D 90/08 52/97
4,295,315 A * 10/1981 Lynn-Jones ..... E04B 1/6804 14/73.1
4,622,784 A * 11/1986 Black ..... E04B 1/6806 404/64
4,735,395 A * 4/1988 Dahowski ..... E02D 29/16 249/10

(Continued)

*Primary Examiner* — Beth A Stephan
(74) *Attorney, Agent, or Firm* — Saliwanchik, Lloyd & Eisenschenk

(57) ABSTRACT

The invention concerns a floor-to-wall joint connection "BearStop" device for providing both a water-tight seal, as well as load-bearing and flexibility between two closely abutting or adjacent structures, such as the wall and foundation of a storage tank. Embodiments also provide motion or sliding capabilities to accommodate expansion and contraction in the joint area between the wall and the foundation. A knee section provides a testing channel usable for testing the integrity of the seal.

20 Claims, 5 Drawing Sheets

(56) References Cited

U.S. PATENT DOCUMENTS

| | | | | | |
|---|---|---|---|---|---|
| 4,740,404 | A * | 4/1988 | Otsugu | E01C 11/106 | 404/64 |
| 4,781,003 | A * | 11/1988 | Rizza | E04B 1/6804 | 404/69 |
| 5,328,647 | A * | 7/1994 | Koob | E04B 1/6816 | 264/101 |
| 6,948,716 | B2 * | 9/2005 | Drouin | E04B 1/6807 | 277/606 |
| 7,111,751 | B2 * | 9/2006 | Copley | B65D 90/022 | 220/3.4 |
| 9,116,067 | B1 * | 8/2015 | Reid | G01M 3/20 | |
| 2008/0307858 | A1 * | 12/2008 | McManus | G01M 3/226 | 73/40.7 |
| 2011/0247399 | A1 * | 10/2011 | Schwartz | G01M 3/12 | 73/40.7 |

* cited by examiner

STORAGE TANK FLOOR-WALL JOINT CONNECTION DEVICE

CROSS-REFERENCE TO RELATED APPLICATION

The present application claims the benefit of U.S. Provisional Application Ser. No. 62/492,048, filed Apr. 28, 2017, which is hereby incorporated by reference herein in its entirety, including any figures, tables, nucleic acid sequences, amino acid sequences, or drawings.

BACKGROUND OF INVENTION

In large concrete structures, such as water storage tanks, the vertical walls can be constructed separately from the floor. An issue to be addressed with such structures is the tendency to leak through unintended voids created between the bottom of the walls and the floor. In some instances, this leakage can be inhibited by utilizing waterstops that are intended to provide a seal between the wall and the floor.

A waterstop is a flexible waterproof material placed at a joint between the concrete wall and floor to prevent the passage of water. Joints in concrete structures that are subject to a hydrostatic load are typically constructed with waterstops bridging the joints. In concrete joints subject to expansion and contraction, the waterstop is preferably designed to accommodate itself to movement. Typical applications for waterstops include large industrial tanks, sewage plants, water filtration plants, reservoirs, swimming pools, roofs, dams, foundations, retaining walls, and any concrete structure requiring watertight joints.

Waterstop systems are utilized particularly in the concrete tank construction industry to prevent the tank contents, such as water, from penetrating through the joints at the base of the tank where the walls meet the floor. Normally, waterstop systems are anchored directly into the concrete or adhered or fastened directly to the surface of the concrete. This configuration can inhibit access to the waterstop and joint for inspection and repair. Known waterstop systems are designed in recognition of the fact that concrete structures can experience significant movement at the joints, for example, the joint between the bottom edge of an upright wall and the floor, in response to changes in liquid level, climatic cycles, environmental changes, and the like. Consequently, waterstop systems are commonly made from various types of plastic and rubber because of their durability and flexibility.

Another product that is often employed with concrete structures is bearing pads. Bearing pads are used in the joint between two concrete structures to transfer load and movement from one structure to another. For example, bearing pads are often utilized between large concrete structures, such as between the vertical I-beams and horizontal slab surfaces of bridges. They can also compensate for irregularities in between surfaces and reduce wear and spalling that can occur between concrete or other types of structures. Bearing pads also act as a safety mechanism by providing flexibility in joints to inhibit damage from flexing or bending and absorbing and dissipating loads.

Typically, depending upon the type of concrete structures and use, either a waterstop or a bearing pad is utilized in a joint. Thus, to make a joint between two concrete sections both flexible and waterproof requires positioning two separate devices. In some cases, however, only one device can be used. There is a need in the industry for a device that can provide features of both a waterstop and a bearing pad, such that a single device can meet the needs for both.

BRIEF SUMMARY OF THE INVENTION

The present invention pertains generally to floor-to-wall (floor-wall) joint connection devices, and the structures, such as concrete storage tanks, that incorporate floor-wall joint connection devices between a foundation (floor) and the bottom edge of a wall. More specifically, the subject invention pertains to a device that combines characteristics of both a waterstop and a bearing pad to provide a watertight seal, as well as load-bearing and flexing capabilities, between concrete joints. Embodiments of the subject invention can be utilized in the joint between any of a variety of concrete structures. A joint is the area where two structures come together and/or interact. It can be particularly advantageous at the joint between the wall and foundation of concrete storage tanks. More specifically, embodiments of the subject invention can be utilized with tank structures that are entirely, or at least partially, cast in place.

The invention also concerns a method for sealing a joint between a floor or foundation and an upright wall having a lower edge disposed adjacent to the floor or foundation. The method comprises utilizing a floor-to-wall (floor-wall) joint connection device described herein and installing the device in the joint between a wall and a floor or foundation. One side of the device can be operably connected to form a watertight seal with a lower edge of the wall, and the opposite end can be operably connecting to form a watertight seal with the floor or foundation, thereby providing a watertight seal, as well as load-bearing, flexing, and motion capabilities between the wall and the floor or foundation. The floor-wall joint connection device is particularly useful with, though not limited to, relatively smaller concrete storage tanks of between about 30 ft. and about 70 ft in diameter, and of any volume.

Embodiments of the subject invention provide a "BearStop" that includes a horizontal bearing pad section that operably receives the bottom edge and/or bottom sides of a wall and a vertical anchor section, downwardly-directed from the bearing pad section that is embedded in or operably connects or attaches to the floor or foundation.

In a further embodiment, there is a knee section operably connecting the bearing pad section and anchoring section. The knee section extends from the joint between the wall and the floor to seal the joint between the bearing pad section and the anchor section. The knee section also provides a testing and diagnostic capability. When installed between a floor and a wall, the knee section (or "knee") provides an enclosed testing channel that advantageously facilitates hydrostatic or pneumatic pressure testing of the seal formed in the joint. The enclosed testing channel extending from the joint can be filled with pressurized air, water, or another fluid. Should the seal between the wall and floor be imperfect, the air, water, or other fluid can be observed leaking from the joint. The BearStop allows the seal in the joint to be tested prior to being put into full use and allows any leak to be more quickly detected and corrected.

The BearStop embodiments of the subject invention provide certain advantages when used on flexible base tanks or sliding base pre-stressed concrete tanks, such as:

a. eliminating the need for a separate wall bearing pad and waterstop;
b. providing a continuous watertight barrier extending from the wall, through the floor-wall joint, down into the concrete floor;

c. ensuring superior leak-free tank designs by providing a positive way to hydrostatically or pneumatically test the seal prior to placing the tank or other structure in service;

d. utilizing a knee section ("knee") facilitates easy detection of any leaks prior to placing the tank in service to ensure a watertight floor-wall joint;

e. accommodating radial movement (outward expansion) of the wall relative to the tank floor; and f. facilitating easy repair.

The subject invention successfully addresses the issue of having to use either or both a bearing pad or water stop between concrete structures, by providing a device having the characteristics of both, and provides certain attributes and advantages, which have not been realized by other devices. In particular, the subject invention provides novel and highly effective improvements to currently known devices used in concrete joints.

BRIEF DESCRIPTION OF THE DRAWINGS

In order that a more precise understanding of the above recited invention can be obtained, a more particular description of the invention briefly described above will be rendered by reference to specific embodiments thereof that are illustrated in the appended drawings. Certain drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which.

DETAILED DESCRIPTION OF THE INVENTION

Figure 1:
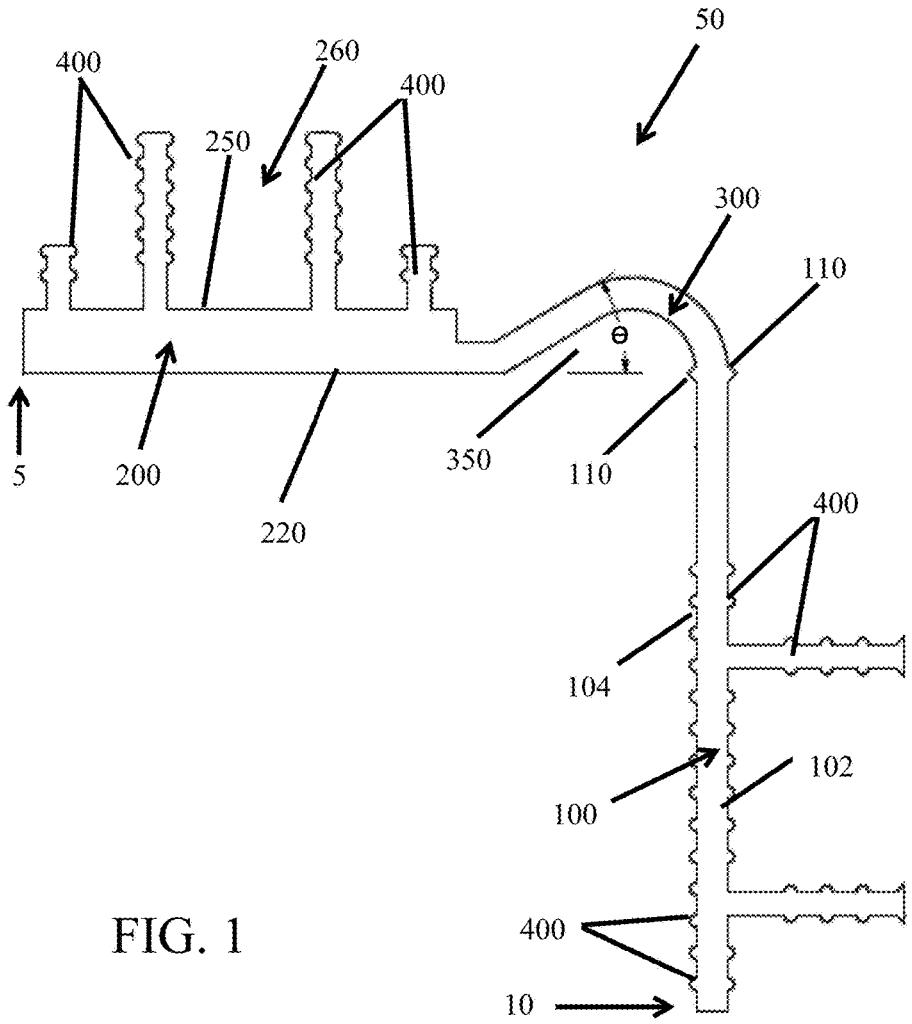
FIG. 1 shows an elevational cross-sectional diagram illustrating an embodiment of a BearStop, according to embodiments of the subject invention.

The subject invention pertains to a device that can be used to seal the joint between two closely abutting or adjacent structures, such as two concrete or partially concrete structures. More specifically, the subject invention provides one or more embodiments of a dual-acting device, referred to herein as a "BearStop," capable of providing both a watertight seal, as well as load-bearing and flexibility, between two closely abutting or adjacent structures. Certain embodiments also provide motion or sliding capabilities to accommodate expansion and contraction of one or more adjacent structures in the joint area.

It is common knowledge in the art that the contents of a liquid-containing storage tank (or "tank"), such as, for example, a water tank, tend to penetrate into the joint area, between the lower edge of the wall and the floor, which is often ameliorated with a device such as a waterstop. Accordingly, tanks are often provided with a waterstop structure that is positioned inside the tank, between the wall and floor or foundation of the tank, to inhibit penetration of the contents of the tank into the joint area. A waterstrop is typically an elongated structure rolled or laid out between the floor and wall of a storage tank.

A bearing pad serves the purpose of protecting two surfaces in close abutment. They are used particularly on large concrete structures where one concrete structure abuts another concrete structure. Such structures are subject to expansion and contraction and are often subjected to heavy loads. Bearing pads help to reduce wear between two concrete structures and provide flexibility.

The subject invention provides a device having characteristics of a waterstop and a bearing pad. Referred to herein interchangeably as a "BearStop" or "BearStop device", embodiments of the subject invention can serve the dual functions of a waterstop and a bearing pad, integrated into one device. The BearStop is positioned between the wall and the floor, for example, between a tank wall and a tank foundation). A BearStop can connect the wall to the floor (for example, connecting the tank wall to the tank floor) and provide sealing and load-bearing therebetween, and accomodates independent movement between the wall and the floor (e.g., radial movement (outward expansion) of the wall relative to the tank floor).

A BearStop of the subject invention also provides a knee section that forms a testing channel. The testing channel can be advantageously used to pressure test the seal formed by the BearStop after installation. By injecting a fluid, such as air or water, into the testing channel, leaks in the seal can be detected and corrected before the tank is put into use.

The following description will disclose that the subject invention is particularly useful in the field of concrete tank design, such as pre-stressed concrete tank designs, in particular cast-in-place or at least partially cast-in-place, concrete tanks that hold a liquid, such as, by way of example, water or petroleum products. However, a person with skill in the art will be able to recognize numerous other structures and uses that would be applicable to the devices and methods of the subject invention. Thus, while the subject application describes, and many of the terms herein relate to, a use with pre-stressed concrete tanks, other uses and modifications thereof, apparent to a person with skill in the art and having benefit of the subject disclosure, are contemplated to be within the scope of the present invention.

In the description that follows, a number of terms are utilized. In order to provide a clear and consistent understanding of the specification and claims, including the scope to be given such terms, the following definitions are provided.

The term "wall" as used herein, describes a typically upright structure capable of forming a joint with another structure.

The wall of a storage tank can extend in a horizontal direction and be constructed as a tilt-up panel or as a shotcrete or cast wall formed in place. In the latter case, the wall can further comprise a series of side-by-side panels or a continuous wall. That is to say, the wall can be any kind of wall known, in the art such as that known in the concrete tank construction field. As used in this specification, the term "wall" is intended to encompass wall panels which are arranged in side-by-side relationship as well as continuous walls which extend continuously around the periphery of a tank. A wall can further include any of a variety of embedded or implanted objects including, but not limited to, pre-stressing strands or rods, plates, diaphragms, pipes, wires, or other objects. Thus, the embodiments of the subject invention are not limited to use with wall structures that are solely concrete.

As used herein, the terms "floor" and "foundation", which are used interchangeably, refer to any usually horizontal structure capable of forming a joint, or contact area, with another structure placed thereon, such as a wall. In some embodiments, the joint is between a wall and foundation that are perpendicular, or approximately perpendicular, to each other. A foundation can be concrete, but is not limited thereto, and can include any of a variety of embedded or implanted objects, including, but not limited to pre-stressing strands or rods, plates, diaphragms, pipes, wires, or other objects. Thus, the embodiments of the subject invention are not limited to use with foundation structures that are solely concrete. Furthermore, a floor or foundation can be cast in place or formed of one or more pre-cast sections, or some combination thereof.

Furthermore, the terms "about" or "approximately," as used herein, are defined as at least close to a given value or either end of a range as is necessary to cover manufacturin variances, equipment tolerances, and normal variances in material or apparatuses, as understood by those skilled in the art.

Reference is also made throughout the application to the "proximal end" or "proximal direction" and "distal end" or "distal direction." As used herein, the proximal end or proximal direction is that furthest end located above or outside of the foundation. Conversely, the distal end or distal direction is that furthest end which is embedded, emplaced, or otherwise operably connected with the foundation of a structure. By way of non-limiting example, the distal end of a BearStop can be embedded within a tank concrete foundation and the proximal end of a BearStop can support a tank wall. Related thereto is the Width (W) of a BearStop, which is the distance between the proximal end and the distal end.

Finally, as used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions. The "connection" or "engagement" may be direct, or indirect, physical or remote.

It should be understood that the use of "and/or" is defined inclusively, such that the term "a and/or b" should be read to include the sets: "a and b," "a or b," "a," and "b."

It is to be understood that the figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

The present invention is more particularly described in the following examples that are intended to be illustrative only because numerous modifications and variations therein will be apparent to those skilled in the art. As used in the specification and in the claims, the singular for "a," "an" and "the" include plural referents unless the context clearly dictates otherwise.

In general, a BearStop includes a generally horizontally extending section (referred to herein as a "bearing pad section") and a generally vertical or downwardly extending section (referred to herein as an "anchor" or "anchor section"), wherein the bearing pad section is operably connected to the anchor section by a flexible "knee section," which can exist as a pleat, fold, or bulbous extension between these two sections. In some embodiments, when installed at the joint or junction of a wall and floor, the anchor section is embedded in the floor or foundation and can be generally perpendicular to the bearing pad section.

Reference will be made to the attached Figures on which the same reference numerals are used throughout to indicate the same or similar components. With reference to the attached Figures, which show certain embodiments of a the subject invention, it can be seen in FIG. 1 that a "BearStop" 50 of the subject invention comprises an anchor section 100 that terminates in a distal end 10. A BearStop also comprises a horizontal bearing pad section 200 having a lower sliding surface 220 and an upper supporting surface 250, with the proximal end 5 terminating on the bearing pad section. Between the bearing pad section 200 and the anchor section 100 is a knee section 300 that operably connects the bearing pad section and anchor section. The knee section forms a testing channel 350 by which the BearStop seal can be tested or challenged. Alternative embodiments can include one or more securing features 400 on any of the sections. Each of these general components can have one or more sub-components, which will be discussed in detail below.

In accordance with the concepts and principles of the invention, the BearStop is desirably constructed of a flexible, waterproof material, and is installed in such a way that it extends in a generally horizontal direction along the junction point or joint 15 between a floor and a lower edge of a wall, such as those of a storage tank. In some embodiments, a BearStop is formed of any of a variety of plastics or rubber, for example, thermoplastic material, such as, for example, polyvinylchloride (PVC), High Density Polyethylene (HDPE), Linear Low Density Polyethylene (LLDPE), Very Low Density Polyethylene (VLDPE), Polypropylene (PP), non-specific thermoplastic rubber or a combination of these materials. The main criteria for the selected material is that it be sturdy and strong enough to remain undamaged and resilient for an appropriate number of years during flexing and shifting of the wall relative to the floor or foundation. Ideally, the material used should also have sufficient chemical resistance to contain, along with the wall interior and floor interior, whatever substance may be contained in the tank. The bearing pad section, knee section, and anchor section can each be made of different materials or of the same material. Optionally, the bearing pad section, knee section, and anchor section are integral as a single structural unit.

A BearStop is an elongated structure laid out horizontally between a wall and a foundation. A BearStop is usually constructed from longitudinal lengths (L) of about 20 feet, which are rolled out and welded end to end, often with a butt weld, to achieve the necessary length and/or diameter. For example, multiple 20 foot lengths of a BearStop can be butt welded end to end to form a continuous circular BearStop.

A BearStop of the subject invention can be particularly useful with floor-wall connections on appropriately sized liquid-containing pre-stressed concrete tanks, such as concrete tanks for water and wastewater treatment and storage. It should be understood that the BearStop of the invention is described herein in the context of such concrete tanks; however, the BearStop may be used in other applications that require a watertight wall-floor junction. Potential alternative installations include sewage plants, water filtration plants, reservoirs, swimming pools, roofs, dams, foundations, retaining walls, and other concrete structures requiring watertight joints.

Figure 2:
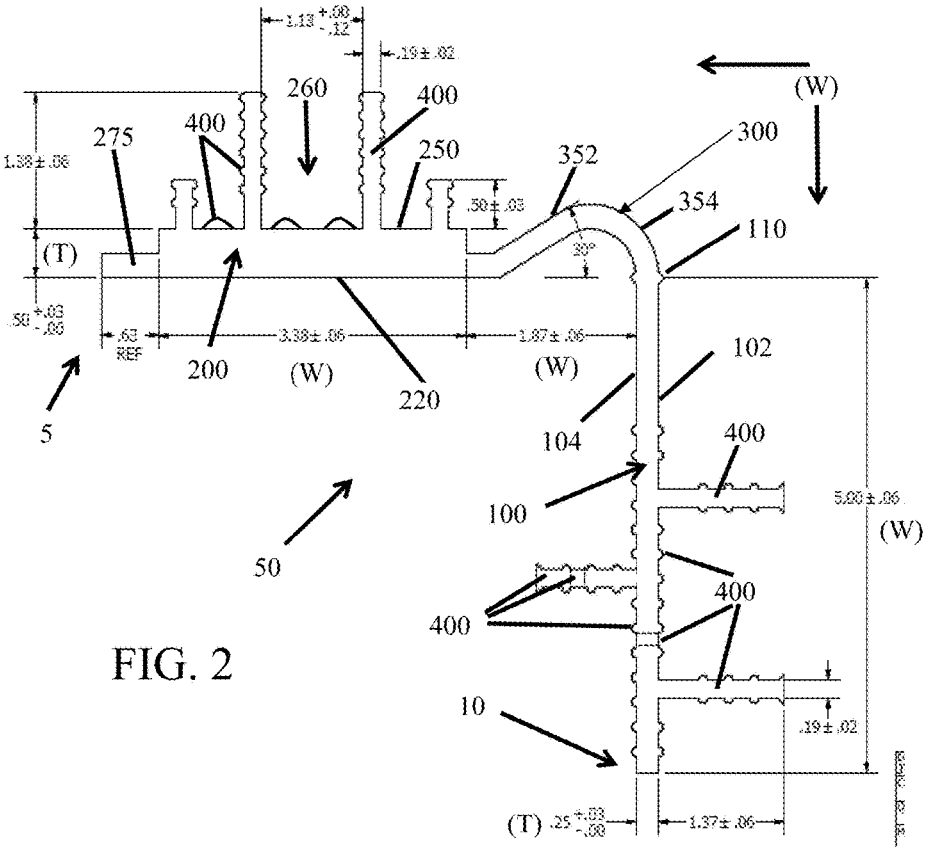
FIG. 2 shows an elevational cross-section diagram illustrating an embodiment of a BearStop, according to the subject invention, having specific, non-limiting dimensions in inches.

With reference to FIGS. 1 and 2, which show a configuration of a BearStop 50 in use, the anchor section 100 is positioned generally perpendicular to the bearing pad section 200, much like a conventional waterstop. In one embodiment, the anchor section is embedded in a concrete floor as the floor is poured. In another embodiment, the anchor section can be grouted into a channel cut in the floor. In a further embodiment, the anchor section can be mechanically attached to the surface of the concrete floor, for example, by bolting, pinning, nailing, adhering, or combinations thereof. This is not shown in the figures, but would be understood by a person of skill in the art.

The choices of materials for use with embodiments of the subject invention have been discussed above. A person of skill in the art will also understand that the dimensions of a BearStop 50 can depend upon the type of material selected. To facilitate an operable connection between the anchor section 100 and the foundation, it can be beneficial for the anchor section to have a width (W) sufficient to form a secure bond with the floor, whether it is being embedded in the floor or mechanically attached. The width of the anchor section is the distance between the distal end 10 and the level of the sliding surface 220 on the bearing pad surface, discussed below, when the anchor section is perpendicular to the bearing pad section. An example of this is shown in FIG. 2.

In one embodiment, the anchor section 100 has a width of at least about 2", 2.5", 3", 3.5", 4", 4.5", 5", 5.5" 6", 6.5", 7", 7.5", 8", and/or 8.5" or a length in a range between any two of the listed values. FIG. 2 illustrates a specific, non-limiting example of a BearStop that is about 5" in length.

Furthermore, the Thickness (T) of an anchor section, which is the distance between an outside surface 102 and an inside surface 104, can be at least about 0.1", 0.125", 0.15", 0.175", 0.2", 0.225", 0.25", 0.275", 0.3", 0.325", 0.35", 0.375", 0.4", 0.425", 0.45", 0.475", 0.5", 0.525", 0.55", 0.575", 0.6", and/or 1.0" or a thickness in a range between any two of the listed values. FIG. 2 illustrates a specific, non-limiting example of a BearStop anchor section with a thickness of about 0.25".

Figure 4B:
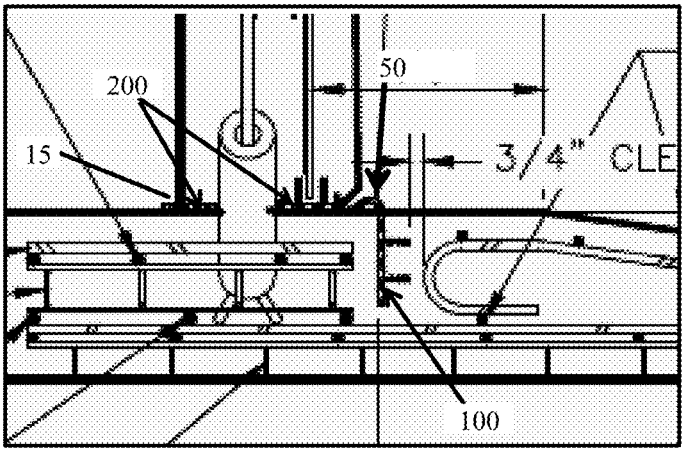
FIG. 4B is an enlarged view of the areas shown in the black square in FIG. 4A.
Figure 5:
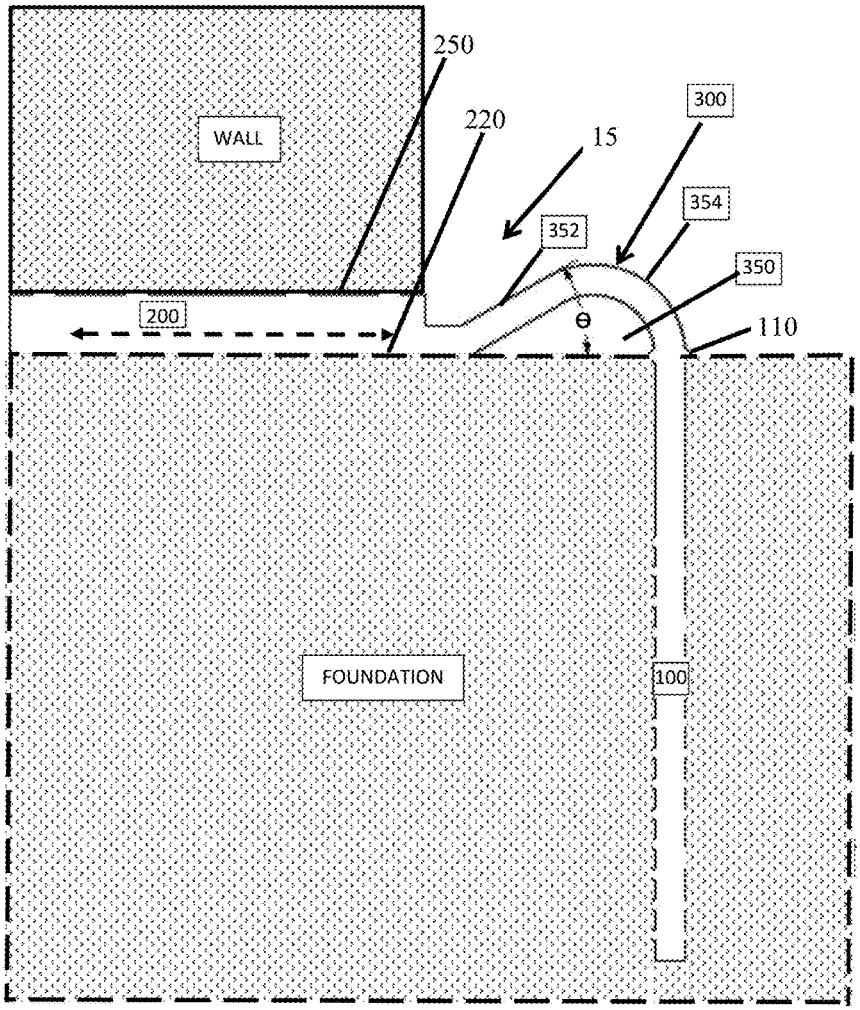
FIG. 5 is a cross-sectional illustration of an embodiment of a BearStop, according to the subject invention, installed within a joint between a wall and a foundation. In this Figure, the enclosed test channel formed by the knee section can be seen.

When being embedded or attached, the anchor section 100 can be positioned, so that the bearing pad section will lie flat against the floor, with the sliding surface fully engaged with the floor surface, such as shown, for example, in FIGS. 4B and 5. Further, as will also be discussed below, the knee section should extend upward from the floor at an angle θ to allow for sliding of the bearing pad section and formation of a testing channel 350, discussed below. To facilitate determining the proper position or depth of the anchor section, there can be one or more guides 110 at the proximal end 5 of the anchor section. In one embodiment, when the bearing pad section and anchor section are perpendicular, the guide is even with, or on the same plane as, the sliding surface 220. A guide can be a visual or tactile marker, such as a marking, projection, or indentation, that indicates where the anchor pad should be positioned for operable connection to the floor. By way of example, the guide can indicate the depth to which the anchor section can be embedded in the floor. By way of another example, the guide can be used to indicate where the anchor section should be positioned on the floor surface for proper mechanical attachment.

When the anchor section is embedded in the concrete of the floor or grouted into a channel in the floor, the concrete or grout material can form a connection with the anchor section. Ideally, the connection is sufficient to secure the anchor section, which in turn secures the knee section 300 and the bearing pad section 200, which can move during use due to expansion and contraction of the concrete wall thereon. To promote connection between the concrete or grout, or other embedding material and the anchor section, there can be one or more securing features 400 on the anchor section. A securing feature, when embedded in the floor, engages with the material of the floor, such as concrete, and inhibits movement, vertical or otherwise, of the anchor section. A securing feature can be an extension from the outside surface 102 or the inside surface 104 of the anchor section that can assist in holding the anchor section in place within the floor.

One example of a securing feature 400 is a fin that can be a generally horizontal projection from the anchor section. The length of a fin can vary depending upon a variety of factors known to those with skill in the art. In one embodiment, there is at least one fin extending from the outside surface 102 of an anchor section, such as shown in FIG. 1. In an alternative embodiment, there can be at least one fin extending from the outside surface and at least one fin extending from the inside surface of an anchor section, such as shown, for example in FIG. 2. A fin can have a length of about 0.5", 1", 1.5", 2", and/or 2.5" or a length in a range between any two of the listed values.

Another example of a securing feature 400 is a rib that rises from the outside surface and/or the inside surface of the anchor section. A rib can be generally shorter in length, rising less than a fin, usually about 0.25" or less. One or more ribs can extend along both sides of an anchor section, such as shown, by way of example, in FIGS. 1 and 2. There can also be ribs on fins, an example of which is also shown in FIGS. 1 and 2.

A securing feature 400 can also be an opening, indentation, or hole in the anchor section in which the material of the floor can integrate or embed. FIG. 2 illustrates examples of securing features as indentations in and as holes through the anchor section.

Figure 3A:
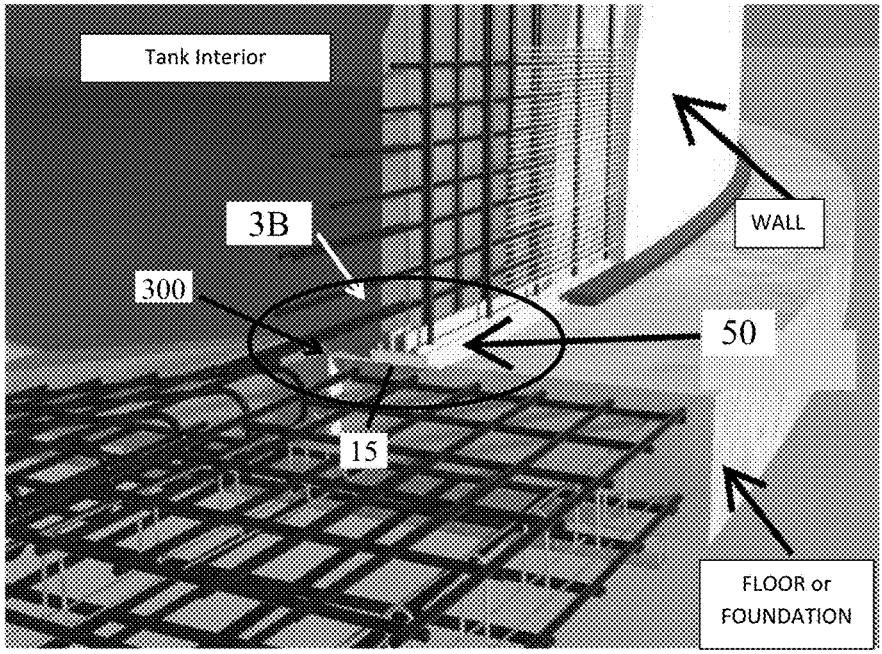
FIG. 3A shows a partially internal and cross-sectional view of an embodiment of a BearStop, according to subject invention, installed in a floor-wall joint.
Figure 3B:
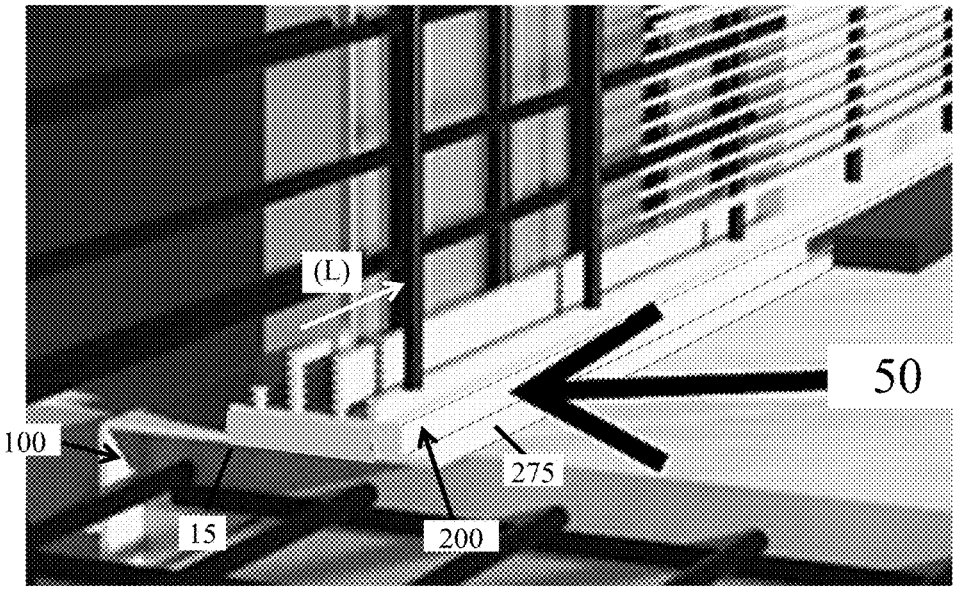
FIG. 3B shows an enlargement of the circled area in FIG. 3A.
Figure 4A:
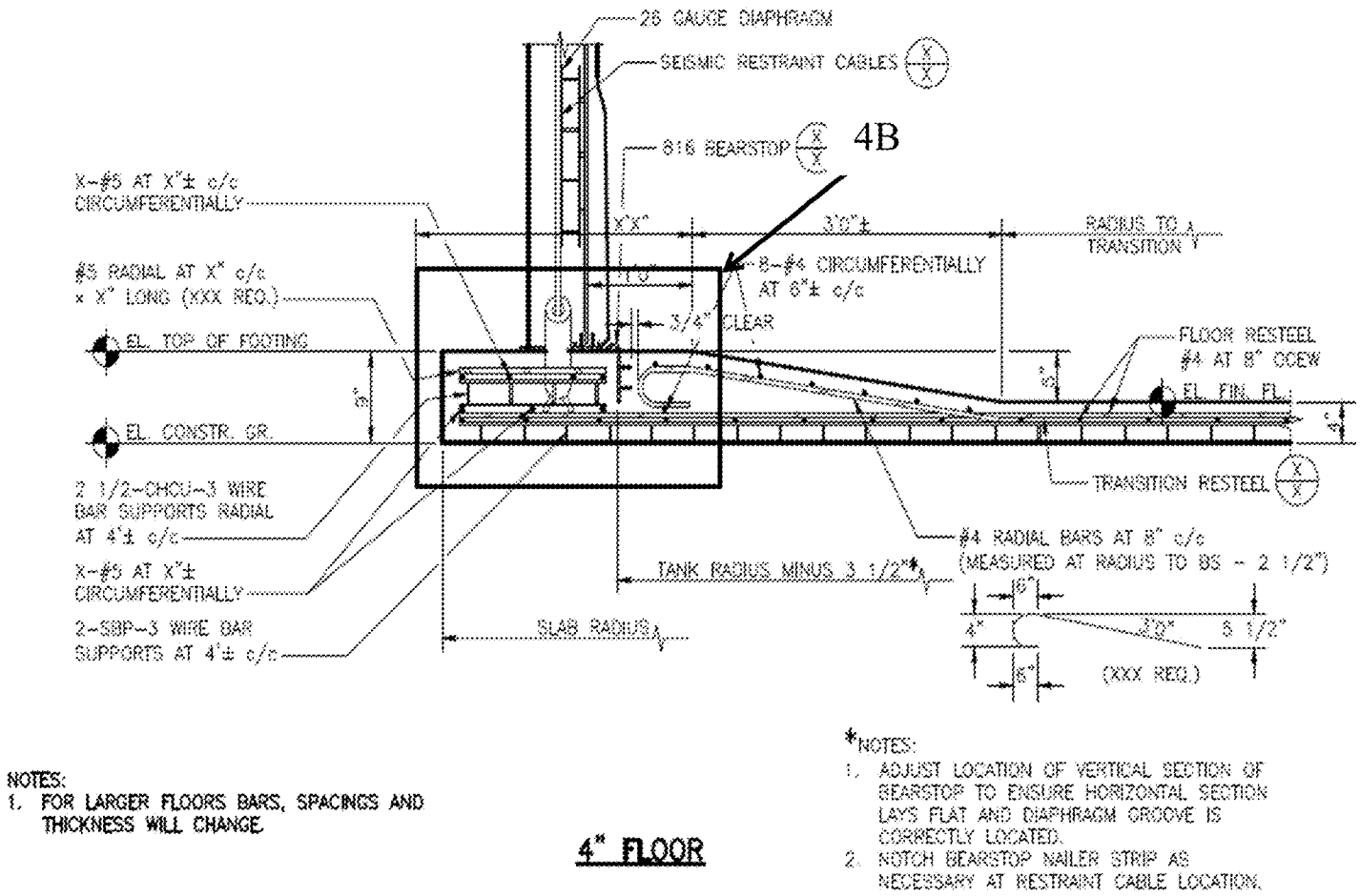
FIG. 4A shows an elevational cross-sectional diagram illustrating a specific, non-limiting, embodiment of a BearStop, according to the subject invention ("816 BearStop"). Dimensions are provided in inches.

At the proximal end 5, opposite to the anchor section at the distal end 10, is the bearing pad section 200, which can be seen, for example, in FIGS. 1, 2, and 3B. The bearing pad section can support a wall substantially vertical to a foundation in which the anchor section is embedded or attached. An example of this is shown in FIGS. 3A, 3B and 5. When utilized with a storage tank, the wall of the tank can rest on the upper supporting surface 250 of the bearing pad section. The bottom or sliding surface 220 can sit on or be against the upper surface of the foundation.

Concrete storage tanks can include an encased diaphragm (e.g., a steel shell diaphragm) that supports water tightness over the tank's life. The steel diaphragm is erected to the specified tank diameter using special formwork known to those with skill in the art. The diaphragm can be manufactured with reentrant angles, to create an irregular surface, which can also aid in forming a mechanical bond with the wall concrete.

One embodiment of a bearing pad section 200 can include one or more securing features 400 that can aid in forming an attachment with the wall. Securing features can extend or arise from the supporting surface so as to be attached to, embedded in, or otherwise operably connected to a wall. One example of a securing feature is a fin extending upward, generally perpendicular to the bearing pad section. A fin can be used to connect a wall to the bearing pad section. The length of a fin can vary depending upon a variety of factors known to those with skill in the art. In one embodiment, there is at least one fin extending from the supporting surface 250 of a bearing pad section, such as shown in FIGS. 1, 2, and 3B. Fins can also have different lengths, such that one or more fins may be shorter than one or more other fins. A fin can have a length of about 0.5", 1", 1.5", 2", and/or 2.5" or a length in a range between any two of the listed values.

Another example of a securing feature 400 is a rib that can rise or extend from the supporting surface of the bearing pad section, as shown in FIG. 2. A rib can be generally shorter in length, rising less than a fin, usually about 0.25" or less. There can also be ribs on fins, an example of which is also shown in FIGS. 1 and 2. The ribs can assist in attaching components of the wall, such as concrete, to the bearing pad section.

In one embodiment, there are two vertical fins arising from the supporting surface 250 to form a mounting slot 260 therebetween, examples of which are shown in FIGS. 1 and 2. A mounting slot can be used for adhering (e.g., by epoxy or other adhesive, Ultra-High-Performance Concrete (UHPC), grout, or any other method) a diaphragm positioned in the mounting slot to the BearStop device. The adherence of the diaphragm to the fins can provide an initial continuous watertight barrier between the wall and the floor.

As discussed above, the anchor section 100 of a BearStop can be cast into the floor concrete. Likewise, the bearing pad section 200 can also be incorporated into the tank wall using pneumatically applied concrete, also known as shotcrete. Additional fins can be employed on the supporting surface to facilitate attachment of the wall to the bearing pad section. FIGS. 1 and 2 illustrate a non-limiting example of a bearing pad section with additional fins on either side of the mounting slot 260.

The material selected for the BearStop can allow the supporting surface 250 of the bearing pad section 200 to conform to irregularities in the bottom of the wall. The bearing pad section can also support the weight of the wall, as seen in the examples in FIGS. 3A, 3B, 4, and 5. The weight of the wall bearing down and pushing the bearing pad section against the foundation forms a watertight seal between the wall and the foundation. As discussed above, there is a variety of materials that can be utilized for a bearing pad.

It is known that storage tanks can experience significant movement in response to changes in liquid level, climatic cycles, environmental changes, ambient temperature, and the like. Therefore, there can be movement at the joints 15 between the bottom edge of an upright wall and the floor of a storage tank. Embodiments of the bearing pad section also provide beneficial sliding motion capabilities. More specifically, embodiments of the subject invention provide a bearing pad section 200, positioned between a floor and the bottom of a wall, with the ability to slide over the floor with the wall thereon. In a further embodiment, one or more securing features 400 are embedded in, attached to, or otherwise operably connected to the wall, which can further facilitate the bearing pad section sliding, with the wall thereon, over the floor. FIG. 5 illustrates an example of the BearStop, shown in FIG. 1, installed between a floor and a wall. It can be seen in this partial cross-section that the securing features are embedded within the concrete of the floor and wall and the dashed arrows indicate sliding motion of the bearing pad section in response to expansion and/or contraction of the wall thereon and/or the floor.

The ability of a bearing pad section 200 to both support the weight of a wall and slide, with the wall thereon, over a floor or foundation can be dependent upon the frictional forces between the bearing pad section and the tank floor. Frictional forces can depend upon a variety of factors including, but not limited to, the type of material utilized for the BearStop, the weight of the wall, the thickness (T) of the bearing pad section, the type of surface on the foundation, ambient conditions, and other factors known to those with skill in the art. In one embodiment, the thickness of the bearing pad section is larger than the thickness of an anchor section.

The dimensions of a bearing pad section can also affect weight-bearing and frictional forces. The BearStop embodiments of the subject invention are particularly useful on relatively smaller storage tanks, typically less than 70 feet in diameter. Thus, embodiments of a BearStop can have a bearing pad section 200 that has a thickness (T) of at least about 0.25", 0.26", 0.27", 0.28", 0.29", 0.30", 0.31", 0.32", 0.33", 0.34", 0.35", 0.36", 0.37", 0.38", 0.39", 0.40", 0.41", 0.42", 0.43", 0.44", 0.45", 0.46", 0.47", 0.48", 0.49", 0.5", 0.51", 0.52", 0.53", 0.54", 0.55", 0.56", 0.57", 0.58", 0.59", 0.6", 0.61", 0.62", 0.63", 0.64", 0.65", 0.66", 0.67", 0.69", 0.68", and/or 0.70" or a thickness in a range between any two of the listed values. Further embodiments of a BearStop can have a bearing pad section with a width (W)—the distance between the proximal end 5 and the start of the knee section 300—of at least about 2.0", 2.1", 2.2, 2.3", 2.4", 2.5", 2.6", 2.7", 2.8", 2.9", 3.0", 3.1", 3.2", 3.3", 3.4", 3.5", 3.6", 3.7", 3.8", 3.9", 4.0", 4.1", 4.2", 4.3", 4.4", and/or 4.5" or a width in a range between any two of the listed values.

Between the bearing pad section 200 and the anchor section 100 is a knee section 300 that serves as a connection element between the bearing pad section and the anchor section of the BearStop 50. The knee section can complete the seal between the wall and the foundation. The knee section can be flexible and resilient to tolerate flexing as the bearing pad section slides with the wall relative to the floor without tearing or other loss of structural integrity. In one embodiment, the BearStop is installed between a wall and a foundation, as described above and shown in the Figures, and the knee section extends from the joint 15 on one side and from the anchor section embedded in the floor on the opposite side. In a further embodiment, the knee section extends from the joint so as to be on the interior of a storage tank, such as shown, for example, in FIG. 3A.

When utilized with a storage tank, a BearStop 50 is configured as a continuous, usually circular, apparatus, as indicated in FIG. 3A showing an embodiment of a BearStop 50 on a tank. When the wall is constructed on the bearing pad section 200 and the anchor section 100 is embedded or attached to the foundation, the knee section forms an enclosed, tubular testing channel 350 on the foundation and around the circumference of the wall, one example of which is shown in FIG. 5.

The knee section 300 forms an enclosed testing channel 350. The testing channel can be used to pneumatically or hydraulically test the integrity of the BearStop seal. The testing channel can be filled with air, water, or any other fluid until a desired pressure is reached. If there is a leak between the BearStop 50 and the wall, and/or foundation, the pressurized fluid can be seen or detected coming from the leak area. In one embodiment, the testing channel is used to conduct pneumatic tests with pressurized with air. The joint 15 can be covered or treated with soapy water or a viscous fluid. Any leaks can be detected by the presence of bubbles escaping from the joint area. In another embodiment, the testing channel is used to conduct hydraulic tests with pressurized water or other liquid, which can be seen or detected leaking from the joint or other area of the BearStop. The pressurizing fluid can have a visible color that allows it to be seen leaking from around the BearStop. Alternatively, the pressurizing fluid contains a marker that can be detected with equipment that recognizes the marker. For example, the testing channel can be filled with radon gas, carbon dioxide, methane, or other gas for which detectors are commonly known and available.

Ideally, the pressure in a testing channel 350 is sufficient to determine if there is a leak. Thus, the pressure in the testing channel is not required to test the limits of the BearStop seal, but only to determine if the seal is complete. Any escape of air or fluid from around the BearStop is an indication that the seal is not complete. In one embodiment, the pressure within a testing channel is between about 3 p.s.i. to about 15 p.s.i. In a more particular embodiment, the pressure within a testing channel is between about 4 p.s.i. to about 12 p.s.i. In yet a more particular embodiment, the pressure within a testing channel is between about 5 p.s.i. and about 10 p.s.i. A still more particular embodiment has a testing channel pressure of between about 6 p.s.i. and about 8 p.s.i. In a specific embodiment, the pressure in a testing channel is about 7 p.s.i.

The configuration and dimensions of a knee section 300 can vary depending upon any of a variety of factors known to those with skill in the art, such as, for example, the expected or calculated maximum expansion and/or contraction of the tank wall, the material of the knee section, circumference of the tank, the required size or volume of the testing channel, the amount of pressure to be exerted on the knee section by the testing fluid, and other factors known to those with skill in the art. Variations in a knee section that provide the same functionality, in substantially the way as described herein, with substantially the same desired results, are within the scope of this invention.

Although any portion of a BearStop can be susceptible to leaking, the contact point between the sliding surface 220 of a bearing pad section 200 and the foundation can be the most vulnerable. As described above, there is no mechanical connection between the sliding surface and the foundation. Thus, it is the weight of the wall and the frictional forces between the bearing pad section and the surface of the foundation that are relied upon to prevent leaks. This can also be the most difficult area to repair after a storage tank is filled. The testing channel can be uniquely and advantageously used to test or challenge the seal between the bearing pad section and the foundation.

In one embodiment, a knee section has a wedge shape with an ascending ramp 352 that leads to a curved downward shoulder 354. The ramp extends from the bearing pad section 200 and the curved shoulder extends from the anchor section 100. FIGS. 2 and 5 illustrate the configuration of a knee section relative to a bearing pad section and an anchor section. As seen in FIGS. 3A, 3B, 4A, and 5, the lower end of the ramp extends out from the joint 15. This can be advantageous for increasing fluid pressure in the area of the sliding surface 220 and the foundation, which can ensure proper testing.

As discussed above, the bearing pad section 200 can slide, when the wall thereon expands and/or contracts, over the foundation. Thus, the knee section should provide sufficient flexibility for the bearing pad section to slide without tearing or damaging the BearStop. As also discussed above, the testing channel should be of sufficient volume to achieve the necessary pneumatic or hydraulic testing pressure. The angle θ of the ramp can be a determining factor in the size of a knee section.

In one embodiment, the angle θ of the ramp 352 with respect to the sliding surface 220 of the bearing pad section is at least about 5°, 10°, 15°, 20°, 25°, 30°, 35°, 40°, 50°, 55°, 60°, 65°, 70°, 75°, 80°, 85°, and/or 90° between 1 degree and 90 degrees or an angle in a range between any two of the listed values. FIG. 2 illustrates a specific, non-limiting embodiment of a knee section that has ramp angle θ of 30°.

In a further embodiment, the width of the knee section, which is the distance between wherein it connects to the bearing pad section and wherein it connects to the anchor section is at least about 1", 1.1", 1.2", 1.3", 1.4", 1.5", 1.6", 1.7", 1.8", 1.9", 2.0", 2.1", 2.2", 2.3", 2.4", 2.5", 2.6", 2.7", 2.8", 2.9" and 3.0" or a width in a range between any two of the listed values. FIG. 2 illustrations a specific, non-limiting embodiment of a knee section that has a width of 1.87".

When the anchor section 100 is embedded in the foundation, the bearing pad section 200 can be folded over so that the sliding surface 220 is against the upper surface of the foundation. A wall or other structure is constructed on the folded over or relatively horizontally-disposed bearing pad section. Depending upon the one or more types of material utilized for a BearStop, the bearing pad section can have a tendency to stand upright, so as to be perpendicular to the foundation. In one embodiment, there is a nail strip 275 extending from at or about the proximal end 5 of the bearing pad section 200. An example of a nail strip is shown in FIGS. 2 and 3B. The nail strip can be a lip or projection from the bearing pad section through which a plurality of nails, staples, bolts, or other fasteners can puncture and hold the bearing pad section sufficiently horizontal so that a wall or other structure can be more easily constructed on the bearing pad section. When the bearing pad section moves or slides over the foundation, as described above, fasteners going through the nail strip 275 can tear through the nail strip as it pulls away from the fasteners. This is acceptable and should not affect the seal between the bearing pad section and the foundation or its ability to move or slide.

Embodiments of a BearStop interact with the storage tank wall, floor, and diaphragm (or other structural member of the wall interior) to provide a superior watertight connection that is also capable of accomodating radial movement of the tank wall relative to the floor. The wall can be attached to the bearing pad section, ensuring a continuous watertight connection between the wall and the tank floor. The exposed interior "knee" is also used to facilitate pneumatic or hydraulic testing of the BearStop joint prior to placing the tank into service. If there is a leak, the exposed "knee" section of the BearStop permits quick access for repair. The BearStop embodiments of the subject invention are particularly useful with smaller storage tanks and represent an improvement in sealing the wall and foundation of such storage tanks.

The scope of the invention is not limited by the specific examples and suggested procedures and uses related herein since modifications can be made within such scope from the information provided by this specification to those skilled in the art.

All patents, patent applications, provisional applications, and other publications referred to or cited herein are incorporated by reference in their entirety, including all figures, dimensions, and tables, to the extent they are not inconsistent with the explicit teachings of this specification.

What is claimed is:

1. A BearStop device, adapted to seal a joint between a wall and a foundation, comprising:

a bearing pad section having a supporting surface, configured to support a wall, and a sliding surface, configured to slidably engage with the foundation;

an anchor section that is perpendicular to the bearing pad section and configured to be embedded within the foundation;

at least one guide disposed proximal to the anchor section and parallel to the sliding surface for indicating a depth to which the anchor section is embedded in the foundation;

a knee section, operably connecting the bearing pad section and the anchor section, having a ramp forming an angle relative to the sliding surface and a curved shoulder proximal to the at least one guide, such that, when the Bearstop is installed, the knee section provides a testing channel configured above the surface of the foundation.

2. The BearStop device, according to claim 1, further comprising one or more securing features.

3. The BearStop device, according to claim 1, wherein the ramp forms an angle of between about 5° and 90°.

4. The BearStop device, according to claim 3, wherein the ramp forms an angle of about 30°.

5. The BearStop device, according to claim 1, wherein the bearing pad section has a thickness that is larger than a thickness of the anchor section.

6. The BearStop device, according to claim 1, wherein the anchor section has a width of between about 2" and about 8.5".

7. The BearStop device, according to claim 6, wherein the bearing pad section has a width of between about 2" and about 4.5".

8. The BearStop device, according to claim 7, wherein the knee section has a width of between about 1" and about 3".

9. The BearStop device, according to claim 1, having a total width of about 11".

10. A method for sealing a joint, adapted to be used between a wall and a foundation of a storage tank, comprising:

embedding the anchor section of the BearStop device, according to claim 1, so that the at least one guide is configured approximately level with the foundation, positioning the bearing pad section, of the Bearstop device, with the sliding surface against the foundation, so as to facilitating movement between the wall and the foundation, and connecting the wall to the bearing pad section, with the knee section extending from the joint, thereby sealing the joint between the wall and the foundation and forming a testing channel between the knee section and the foundation on an interior the storage tank.

11. The method, according to claim 10, wherein the BearStop device further comprises at least one securing feature on the supporting surface.

12. The method, according to claim 11, wherein the at least one securing feature is a fin and the method comprises operably connecting the wall to the fin.

13. The method, according to claim 12, wherein the BearStop device further comprises a nail strip and the method further comprises securing the bearing pad section with the sliding surface against the foundation utilizing the nail strip.

14. The method, according to claim 10, further comprising at least one securing feature on the bearing pad section and the method further comprises connecting the wall to the securing feature.

15. A method for testing a seal, between a wall and a foundation of a storage tank, comprising:

installing a BearStop device, according to claim 1, with the wall operably connected to the bearing pad section and the anchor section embedded in the foundation approximately level with the at least one guide, so that the knee section forms a testing channel configured above the surface of the foundation;

filling the testing channel with a fluid to a prescribed pressure; and observing the BearStop device for fluid leaks.

16. The method, according to claim 15, wherein the fluid is a gas.

17. The method, according to claim 15, wherein the fluid is a liquid.

18. The method, according to claim 15, wherein the BearStop device is observed for leaks prior to the storage tank being put into service.

19. The method, according to claim 18, wherein the prescribed pressure is between about 3 p.s.i and about 15 p.s.i.

20. A concrete tank comprising a wall, a foundation, a joint between the wall and the foundation, and a BearStop device according to claim 1 installed with the bearing pad section at the joint to support the wall and facilitate sliding motion between the wall and the foundation and the anchor section embedded in the foundation to approximately the level of the at least one guide to position the knee section above the foundation on an interior of the tank.

* * * * *